United States Patent [19]

Royster

[11] Patent Number: 4,938,116

[45] Date of Patent: Jul. 3, 1990

[54] RECOIL SYSTEM FOR WEAPONS WITH A RECIPROCATING BREECH BLOCK

[76] Inventor: John L. Royster, 928 S. Yosemite, Denver, Colo. 80237

[21] Appl. No.: 161,195

[22] Filed: Feb. 26, 1988

Related U.S. Application Data

[63] Continuation-in-part of Ser. No. 40,129, Apr. 20, 1987, abandoned.

[51] Int. Cl.[5] ..... F41A 25/12

[52] U.S. Cl. ..... 89/198; 89/196; 89/197

[58] Field of Search ..... 89/190, 194, 195, 196, 89/197

[56] References Cited

U.S. PATENT DOCUMENTS

| | | | |
|---|---|---|---|
| 433,420 | 7/1890 | Pitcher | 89/190 |
| 993,175 | 5/1911 | Knotgen | 89/190 |
| 1,907,164 | 5/1933 | White | 89/190 |
| 2,565,688 | 8/1951 | Horan | 89/194 |
| 2,940,202 | 6/1960 | Harper | 89/194 |
| 3,060,809 | 10/1962 | Tschumi | 89/194 |
| 4,015,512 | 4/1977 | Feerick | 89/190 |
| 4,126,079 | 11/1978 | Perrine | 89/190 |
| 4,522,105 | 6/1985 | Atchisson | 89/195 |

FOREIGN PATENT DOCUMENTS

| | | | |
|---|---|---|---|
| 7337996 | 5/1975 | France | 89/190 |
| 469529 | 3/1952 | Italy | 89/194 |

*Primary Examiner*—Charles T. Jordan
*Assistant Examiner*—Stephen Johnson
*Attorney, Agent, or Firm*—T. M. Gernstein

[57] ABSTRACT

The present invention relates to a firearm, generally of the automatic or semi-automatic type, having a reciprocating breech block normally biased into closed position by a primary recoil absorption system including a spring, the improvement comprising providing a secondary spring-biased recoil absorption system cooperating with the primary one during a portion of the retraction stroke of the block to slow down the movement of the latter before becoming inactive while the primary system slows the block to a stop and reverses its direction and then becoming active to once again cooperate with the primary system during a portion of the return stroke of the block to speed up its return to its original position. The invention also encompasses the improved method for controlling the movement of the breech block in the aforementioned type of weapon during its firing cycle wherein such movement during its initial and final stages is supplemented and abetted by a secondary spring-biased recoil absorption system cooperating with the primary one while, at the same time, leaving the primary system solely responsible during the remainder of the cycle to stop the block and reverse its action.

26 Claims, 6 Drawing Sheets

RECOIL SYSTEM FOR WEAPONS WITH A RECIPROCATING BREECH BLOCK

This application is a continuation-in-part of my copending application Ser. No. 040,129 filed Apr. 20, 1987, now abandoned.

BACKGROUND OF THE INVENTION

1. Field of the Invention

The present invention relates to weapons of the type having a reciprocating block which recoils under the influence of an exploding shell in the chamber against a spring force holding it closed against the breech. As the breech block recoils, it picks up the spent shell casing and ejects it thus clearing the chamber to receive another shell. When the block moves forward again under the influence of a recoil spring, it picks up another shell and moves it into the chamber in position to be fired. Of particular interest are those weapons having reciprocating breech blocks that can accommodate the modern thin-jacketed shells containing a so-called "magnum" load which, when fired, generate sufficient pressure in the chamber to expand the casing and cause the weapon to jam.

2. Description of the Related Art

A .45 caliber pistol develops approximately 390 foot pounds of muzzle energy using a 185 grain bullet which will have a muzzle velocity of around 950 feet per second. This is a very popular weapon, however, it is expensive to shoot in that, at the present time at least, shells of good quality sell for somewhere between $25.00 and $30.00 for a box of fifty.

The Winchester Arms Company introduced a few years ago what is known as a .22 magnum cartridge which presently sells for only about $5.00 for a box of fifty yet, in many respects, it performs comparably to the traditional .45 caliber shell. Using only a 40 grain bullet, it develops 392 foot pounds of muzzle energy and has a 2000 foot per second muzzle velocity using a slow-burning rifle powder. Prospects are that the same cartridge filled with a fast-burning powder charge of equal size will develop muzzle energy of 2000 foot pounds and will have a muzzle velocity of 3200 to 3500 feet per second.

Unfortunately, there have been a lot of problems associated with this particular cartridge caused largely by the fact that it has a very thin-walled jacket and is quite long. What happens is that the casing cannot withstand the bore pressure and, if the block is not held securely in place against the breech for an interval that permits the pressure generated in the bore to decrease substantially, the head of the cartridge casing blows off leaving the rest of the empty jacket in the chamber since there is nothing left for the extractor to get a hold of to extract it. The next cartridge fed into the chamber either jams as it tries to enter the portion of the jacket left behind or, alternatively, the shell fires with the block only partially closed thus causing a serious and potentially very dangerous situation for the shooter. Neither of these options is acceptable and, therefore, there is a need for a solution to this problem of the head of the shell being blown off due to premature opening of the breech.

It can be shown that the pressure pulse associated with rapid burning of the powder contained within the shell casing builds almost instantaneously to a peak and then decays somewhat more slowly as the bullet leaves the muzzle and thereby creates an ever-increasing volume for the gases to expand into. There is, of course, some pressure at which the head of any cartridge will blow off if left unconfined in the chamber of the weapon. Fortunately, most cartridges are designed to withstand the pressure at which damage thereto would occur either by lessening the powder charge or increasing the strength of the shell casing or both. In some thin-jacketed shells filled with a proportionately greater powder charge like the one previously described, this is not the case and the casing can, in fact, rupture if not fully confined in the chamber until the pressure decays to a level at which it is safe to permit the block to back off and open the breech.

The so-called "recoil" of a weapon is that reactive force which causes it to move rearward as the result of the forward motion of the bullet as it exits the barrel and the pressure applied to the breech block by the rapidly-expanding gases trapped in the barrel between the bullet and its now-empty casing. Firearms, especially the handheld type, are equipped with various types of recoil-absorption mechanisms, some mechanical, others hydraulic and, in the case of certain high-powered cartridges, part of the recoil is customarily absorbed by bleeding off a portion of the muzzle pressure and conducting it to a position behind the block. Regardless of the type of recoil-absorption mechanism used, its primary function is that of a shock absorber. In automatic and semi-automatic weapons, on the other hand, the recoil-absorption mechanism is also used to perform the additional function of returning the block to its firing position covering the breech during which excursion it picks up an unfired shell and moves it into the chamber. Whatever the function or functions to be performed by the recoil-absorption mechanism in a firearm, of critical importance is always that of holding the block in place such that it holds the cartridge in the chamber for the interval required, no matter how brief, until the pressure inside the barrel has dissipated to a level at which it can be safely opened. This all-important function is adequately addressed by many recoil-absorption systems designed for use with ordinary ammunition; however, these same systems have proven to be inadequate and very dangerous when employed with thin-jacketed high-powered ammunition. Moreover, just solving the problem of holding the block closed until the muzzle pressure dissipates to a level where the breech can be safely opened is not the entire answer because its solution fails to address the remaining problem of how to best and most efficiently handle the recoil of the block without undue shock to the shooter or an overall loss in accuracy, especially in those rapid-fire firearms having one that reciprocates very quickly.

The prior art systems known to applicant for controlling the excessively high muzzle pressures generated by these modern thin-jacketed cartridges have all been based upon the principal of, first of all, not letting the muzzle pressure build up to the level at which it can damage the shell casing followed by delaying the opening of the breech in some fashion until the muzzle pressure is further reduced to a point at which the breech can be safely opened. Specifically, the muzzled pressure is limited to a level significantly below that which the powder charge would otherwise produce in a closed system by bleeding off a portion of the gas pressure ahead of the bullet as it moves toward the muzzle. While this pressure is confined, nevertheless, it expands into a volume outside the barrel thus lessening the pressure therein well below that which would exist if such an "escape" were not provided. The maximum muzzle pressure is, therefore, limited unless, of course, the bypass system gets plugged up which, frankly, happens very quickly after only a relatively few rounds are fired.

The delay system that is used to hold the block in closed position momentarily until the muzzle pressure further dissipates to a level at which the breech can be safely opened oftentimes comprises a mechanical system of some sort that remains locked until the muzzle pressure bled off from the barrel is shunted around to open it and thus allow the block to retract. Such systems have little, if anything, to do with the absorption of the recoil, only the reduction of the excess muzzle pressure and putting it to use in delaying the opening of the breech. As a matter of fact, essentially the full impact of the recoil is transferred to the shooter through the block and mechanical system holding it closed since, for all practical purposes, nothing in the system yields and provides a shock absorbing function until most of the muzzle pressure has dissipated and its effect has already been felt. In these systems, once the block has been released, its rearward movement is usually slowed down by a conventional spring-biased recoil-absorption mechanism, however, at this point most of the damage has been done and there is very little left in the way of recoil to absorb.

The main difficulty with these systems is that they just do not work. As the powder ignites, all sorts of solid residues are generated which very quickly clog up the bleed-off system rendering it completely, or at least partially, inoperative. Moreover, as the bleed ports and passages become more and more plugged up, the muzzle pressure rises and the whole system fails to achieve that for which it was designed. These systems are most often found in rapid-fire automatic or semi-automatic weapons of the type used by the armed forces, law enforcement people and special security agencies, none of which can tolerate a weapon that cannot be relied upon. Also, the ineffectiveness of these weapons to handle the recoil properly is a major factor in their being highly inaccurate even at short range.

Other systems for handling recoil are purely mechanical and do not involve bleeding off a portion of the muzzle pressure. Some even incorporate block-opening delay mechanisms of one type or another which cooperate with the conventional spring-biased recoil absorption systems to momentarily delay the opening of the breech at which time they become wholly inoperative. As such, they have little or no effect in terms of recoil absorption for the simple reason that they permit nearly all of the reactive forces to pass directly through to the primary recoil absorption system and back to the shooter at the very time these forces are at near their maximum level. In other words, just about the time that the shooter needs the most recoil protection, the supplementary mechanical delay mechanism has ceased to function thus leaving the primary spring-biased conventional system to take care of the major portion of the recoil all by itself. Equally significant, however, is the inability of such systems to hold the block closed under the abnormally high pressures generated inside the barrel of a weapon firing the modern thin-jacketed magnum ammunition. While recoil absorption is important and a much sought-after characteristic in a firearm, especially automatic and semi-automatic ones in terms of accuracy, it is, nevertheless, subordinate to the absolute necessity for holding the breech block closed against the excessive internal pressures generated by the modern-day thin-jacketed ammunition. Insofar as applicant is aware, the only solution to this problem up to the present time involves reducing the peak pressure by bleeding off a portion of the gases generated inside the barrel and using these gases to assist the primary spring-biased recoil system in holding the breech closed until such time as it can be safely opened without blowing off the head of the shell casing.

A properly designed recoil system, whether used for high-powered thin-jacketed ammunition or conventional loads must, of necessity, take into account several other factors such as, for example, the mass and weight of the block versus the length of the weapon and the size of the spring required to bring it to a stop; the rapidity with which the block reciprocates which is also a function of its weight and the spring-bias acting to return it to closed position; the reactive forces which have to be absorbed in order to bring the block to a stop before it strikes some abutment, etc. All of these factors involve trade-offs to some greater or lesser degree but it all gets back, eventually, to initially containing the explosive forces without letting the breech open prematurely and thereafter cancelling out as best one can the reactive forces generated by the confined explosion in the barrel before they reach the shooter.

Accordingly, there is a pressing need for a gasless recoil system for use with firearms of the reciprocating breech block type that is effective for use with all types of ammunition but which is especially useful to contain those excessive forces generated in the barrel by the thin-jacketed ammunition without permitting the breech to open prematurely resulting in the weapon jamming or, worse, causing injury to the shooter. Of secondary importance, but nonetheless significant, is to design such a system which will, in addition, dampen out the reactive forces generated by the explosion inside the barrel thus improving the accuracy of the weapon and the comfort associated with firing it while, at the same time, keeping it light, compact and, in the case of rapid-fire weaponry, manageable in the sense of not firing too fast.

3. Objects of the Invention

It is, therefore, the principal object of the present invention to provide a novel and improved gasless recoil absorption system for firearms of the type employing reciprocating breech blocks.

A second objective of the invention herein disclosed and claimed is that of providing a system of the type aforementioned which is especially useful in those weapons firing thin-walled magnum cartridges.

Another object of the within-described invention is the provision of a recoil absorption system which includes both primary and secondary spring-biased subassemblies, both of which are initially operative to slow down as well as resist the reactive forces acting upon the breech block as it moves away from the breech until these forces are overcome to a degree where those which remain can be handled by the primary system alone whereupon the secondary subassembly becomes essentially inoperative.

Still another object is to provide a purely mechanical recoil absorption system which, due to its unique division of the task of overcoming the reactive forces acting upon the breech block in two or more stages, results in a much more compact yet essentially recoilless weapon having greatly increased accuracy particularly in the rapid-fire automatic and semi-automatic modes.

Yet another object is to provide an automatic weapon which is easier to handle and far more accurate than other rapid-fire weapons of the same caliber, yet, has the fire power of much larger caliber so-called "Class 3" firearms which are more commonly described as "machine guns".

A further objective is that of providing a more compact spring recoil absorption mechanism involving two or more stages of bias cooperating with one another to effectively slow down and eventually stop and reverse even a heavy breech block in a very short distance without, at the same time, shortening the recoil cycle in an automatic weapon to the degree where the rate-of-fire becomes excessive and perhaps faster than that at which the spent shell casing can be ejected and a new round picked up and inserted into the chamber without jamming.

Other objects of the invention forming the subject matter hereof include those of providing a handheld repeating weapon which is readily adapted for use with ammunition of different calibers, loads and shell casings; can be fired a round at a time, semi-automatically or automatically; and a weapon of the type aforementioned which is safe, rugged, compact, versatile, reliable, easy to use and even decorative.

SUMMARY OF THE INVENTION

The foregoing along with other objects are accomplished by the simple, yet unobvious, expedient of providing a gasless purely mechanical recoil absorption system divided into two or more stages which initially are combined and cooperate with one another to not only hold the breech block in position holding the shell in the chamber for the time interval required for the major part of the muzzle pressure to diminish to a level at which the breech can be safely opened but, in addition, continue to cooperate after the block is forced back away from the breech to slow down as well as counteract the remaining reactive forces still acting thereon during a further brief interval until those which remain fall off to a point where one or more of these stages can drop out and become essentially inoperative while the sole remaining stage absorbs whatever recoil is left. Also, after the last of the stages has functioned to stop the rearward excursion of the block and has started it back toward its firing position, the stage or stages that have dropped out recombine therewith to accelerate the block forward and thus speed up the firing cycle while, at the same time, adding the additional force therebehind needed to pick up a new shell and move it into the chamber.

By staging the recoil absorption system, several desirable ends are achieved. By combining the stages initially to hold the breech block in closed position, a very compact system results which is effective to keep the breech covered while the pressure falls to a level at which it can be safely opened even in those instances where thin-jacketed ammunition is used with magnum loads that would otherwise blow the head off the cartridge if the breech were permitted to open prematurely. Such a staged system has proven effective to handle the excessively high muzzle pressures generated by the magnum loads without having to bleed off a portion in order to prevent premature opening of the breech.

While by no means restricted in any way to use with the modern thin-jacketed ammunition carrying magnum loads, the staged, gasless recoil absorption system of the present invention is, nevertheless, especially useful in such applications and in those rapid-fire automatic weapons of the "Class 3" type which traditionally are bulky, difficult to handle and highly inaccurate. A key to the increased accuracy achievable with the staged system forming the subject matter hereof is the fact that the stages continue to cooperate and coact with one another even after the breech has been uncovered to rapidly retard the rearward movement of the block over a very short distance while simultaneously absorbing those reactive forces acting thereon to a degree where a single stage can handle what is left by itself. It is also significant to note that it is during this interval when the block is moving rearwardly most rapidly and the spent shell casing is being extracted from the chamber and ejected, that two or more of these spring-biased systems are acting together to slow down the rearward excursion of the block thus lengthening the first half of the firing cycle. Equally important is what happens on the return stroke of the block during the last half of the firing cycle. Instead of a single stage of spring bias being employed to return the block to its firing position, the stage or stages which have dropped out recombine therewith to speed the block home and provide additional impetus thereto at the very time such additional "kick" is needed to pick up a new round which is heavier than the spent cartridge case due to its powder charge and bullet and insert it into the chamber. Were it not for this staging of the recoil absorption sequence, a much heavier recoil spring would have to be used thus oftentimes speeding up the firing cycle to a degree where it becomes impossible to handle the mechanical functions of ejecting the spent shell casing and picking up a new round.

Looking at applicant's novel recoil absorption system in another way, it consists of at least five different stages of control over the movement of the block during its firing cycle, two of the control stages involving only a single spring-biased recoil subassembly functioning as it has in the past, namely, to bring the block to a stop, reverse its direction and start it back forward. In the first control stage, on the other hand, no less than three elements cooperate to hold the block closed until the muzzle pressure diminishes to a level at which the breech can be safely opened. These are, first of all, the primary spring-biased subassembly present in many, if not most, of the prior art reciprocating block weapons; applicant's secondary spring-biased subassembly which acts in concert with the first while the breech block is closed and for an interval thereafter; and, the block itself which due to its mass and its being "at rest" requires a certain amount of additional force to get it moving beyond that which is required to keep it moving. Thus, the first stage is that in which the first and second spring-biased recoil subassemblies cooperate with one another and with the mass of the block itself to hold the latter closed until the muzzle pressure has diminished to a level at which the breech can be safely opened.

The second of the control stages is that in which the block has begun to move and the initial force required to overcome its starting friction has been overcome. During this early movement, the block is also dissipating some of the energy imparted thereto by the explosion in the chamber to extract the spent shell casing. Nevertheless, it is still moving back away from the breech at its fastest rate and additional retardant force is desirable to slow it down. It is during this interval that two or more of the spring-biased recoil subassemblies act in concert with one another to slow down the movement of the block.

The third control stage is where all but one of the two or more stages which have been acting in concert with one another to slow the movement of the block to a level where a single stage can take over have dropped out of the system and become essentially inoperative while the one remaining slows the block to a stop.

The fourth stage is one in which a single spring-biased subassembly is all that is functional but acting in the opposite direction to begin returning the block to its closed position. As previously noted, the third and fourth stages are conventional and performed by almost all of the existing single stage spring-biased recoil absorption systems.

The fifth stage is, once again, unique and consists of that in which the inoperative stages become operative again to cooperate with the one that has remained active throughout the block travel to assist the latter in picking up a new unfired shell and assist it in the insertion thereof into the chamber as the block closes against the breech. As these subassemblies cooperate with one another in the manner just mentioned, the return of the block is speeded up at the point in the firing cycle when it only has the recoil system acting upon it. The net result is, of course, that the block is slowed down during the first half of the firing cycle when it is moving the fastest under the influence of the reactive forces generated within the barrel but is speeded up during the last half when it has only the recoil system acting upon it. Thus, the total cycling time will remain much the same and not be speeded up to a point where problems begin to occur, yet, the half-cycle intervals will be altered considerably in a manner which is most advantageous. Also, as will be seen presently, additional control cycles can be added by having two or more spring-biased subassemblies that drop out and become active again sequentially.

DESCRIPTION OF THE PREFERRED EMBODIMENTS

Figure 1:
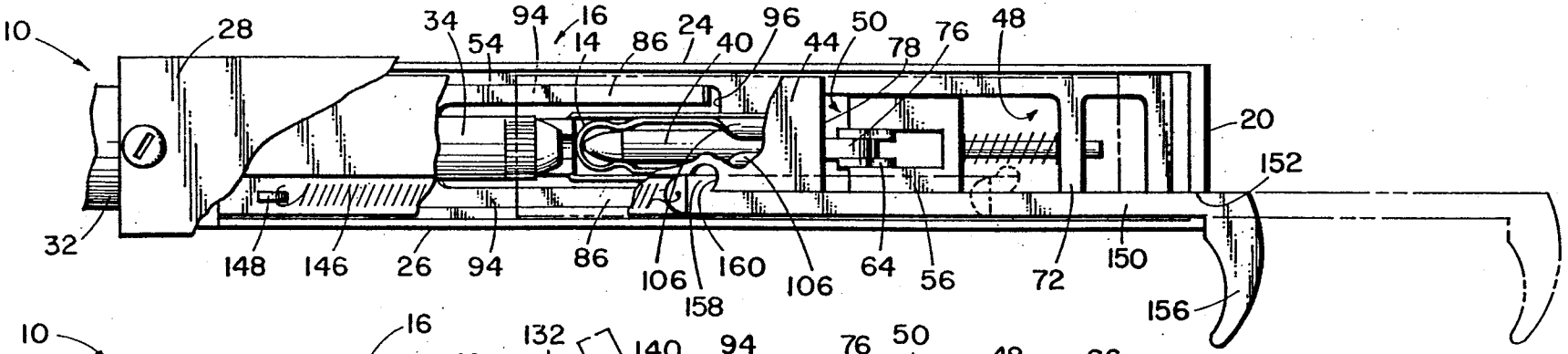
FIG. 1 is a fragmentary top plan view of a rapid-fire weapon having a reciprocating breech block, the firing cycle of which is controlled in stages by two spring-biased recoil absorption systems that function together during portions of the cycle while one drops out and the other acts alone during other portions thereof.

Referring next to the drawings for a detailed description of the present invention, reference numeral 10 has been chosen to broadly identify the firearm forming the subject matter hereof in its entirety while numeral 12 designates the handle housing the multi-round clip 14. A generally box-like rectangular housing or receiver indicated in a general way by reference numeral 16 is made up of front and rear endwalls 18 and 20, respectively; a bottom wall 22; right and left sidewalls 24 and 26, respectively; and, a detachable top wall or coverplate 28. Inside this receiver is housed all the functional mechanisms of the unit.

Figure 2:
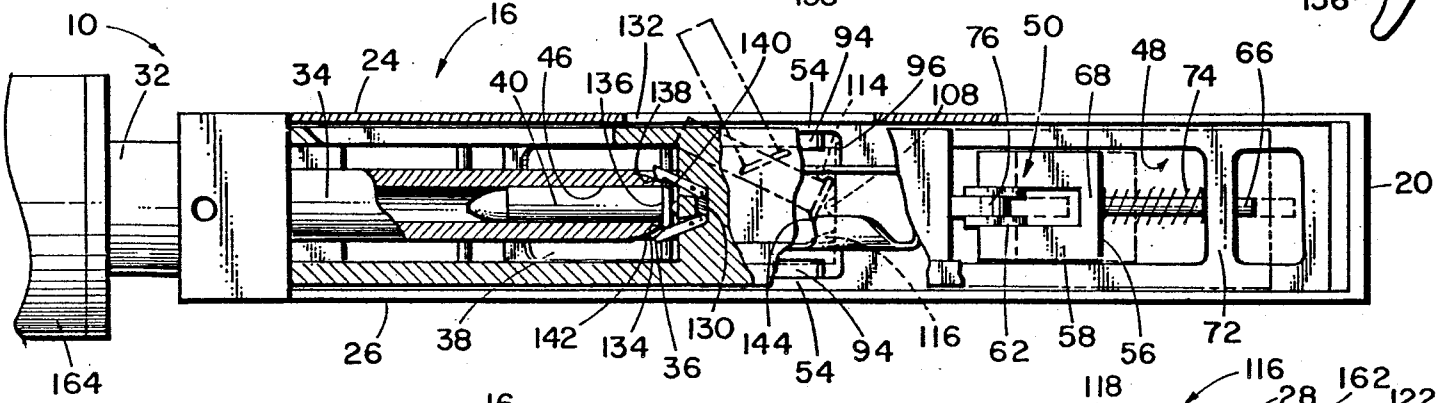
FIG. 2 is a fragmentary top plan view much like FIG. 1 and to the same scale but differing therefrom in that the coverplate and breech block have been removed to reveal the barrel, the support for the latter, the rails atop which the breech block rides and the extractor subassembly.
Figure 4:
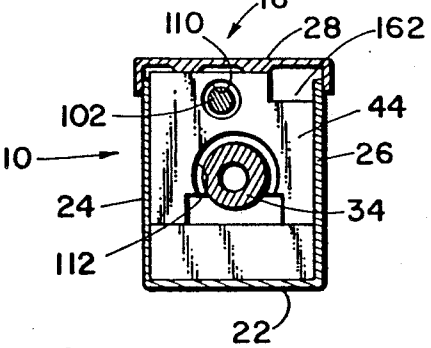
FIG. 4 is a section taken along line 4—4 of FIG. 3.
Figure 3:
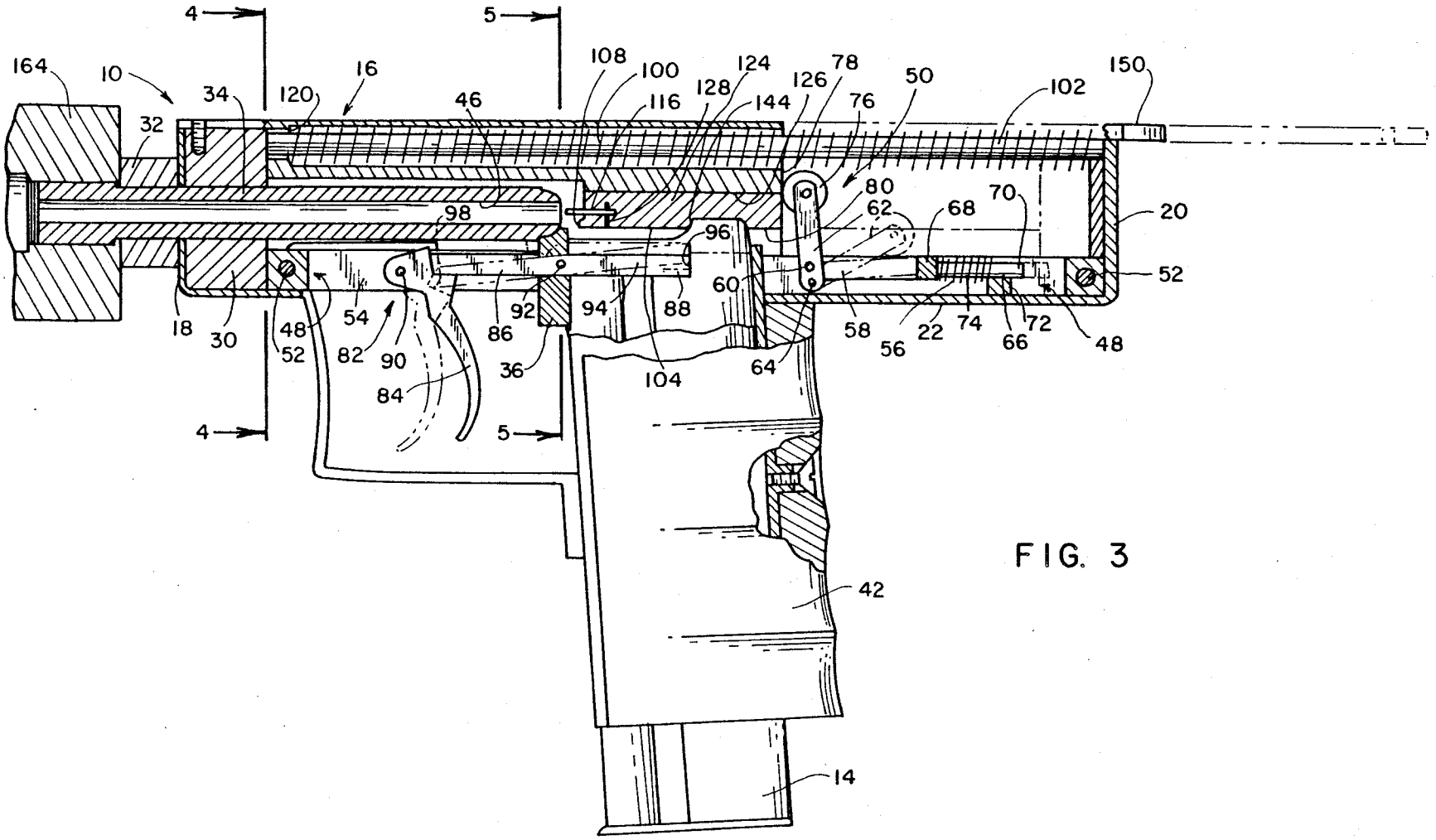
FIG. 3 is still another fragmentary view to the same scale as FIGS. 1 and 2 showing the firearm in elevation with extensive portions thereof broken away and revealed in section.
Figure 6:
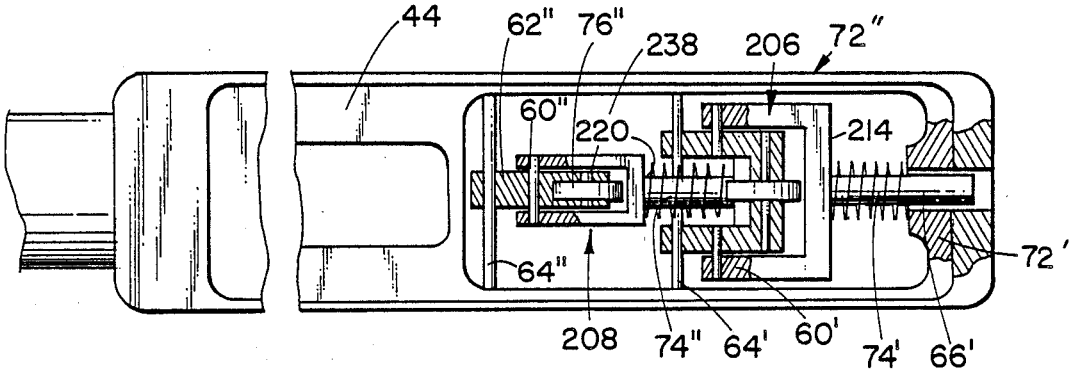
FIG. 6 is a fragmentary top plan view, portions of which have been broken away and shown in section, revealing another embodiment of the secondary spring-biased recoil subassembly wherein three stages of recoil absorption and breech block acceleration are provided instead of just two.

Rear wall 20 is shown provided with a cushioned bumper 20B. A block 30 is located at the front end of the housing and it together with collar 32 on the outside of front wall 18 cooperate with one another to mount the barrel 34 which passes through axially-aligned openings in these three elements as seen most clearly in FIG. 3. In FIGS. 2, 3 and 4, it can be seen that the rear end of the barrel is supported in saddle 36 which projects up through trigger slot 38 in the bottom wall 22 and forms a part of the handle subassembly. The handle 12 comprises a hollow generally elongate tubular sheath that opens into the housing through this same slot 38 in the bottom wall 22 which is widened out some to accommodate the upper end of the clip 14 as well as the shells 40 (FIGS. 1 and 3) contained therein. A handgrip 42 is shown in FIG. 3 covering the handle 12 as is customary with such firearms. The clip 14 is conventional and, of course, includes a spring-biased follower of some type (not shown) that feeds a stack of cartridges 40 one-at-a-time into position to be picked up by the advancing breech block 44 and fed into the shell chamber 46.

One of the most significant improvements present in the firearm 10 is the frame indicated broadly by reference numeral 48 which rests in the bottom of the housing 16 and provides support for the breech block 44 as well as what will be called the "secondary recoil subassembly" that has been identified in a general way by reference numeral 50 and which will be described in detail presently. This frame is held in place front and rear by pins 52 passing across between the sidewalls as shown in FIG. 3. The sides of the frame define a pair of transversely-spaced parallel rails 54 atop which the breech block rides and slides as it moves forwardly into firing position and rearwardly into retracted position during which excursion it grabs a hold of and ejects the spend cartridge case preparatory to picking up another round.

Just to the rear of the point on the bottom wall 22 of the receiver 16 where the clip 14 emerges is located the secondary recoil subassembly 50. Structurally, it can be seen seated on bottom wall 22 of the receiver between the rails 54 of the frame. It has a U-shaped yoke 56 that opens forwardly as seen in FIGS. 1 and 2. Extending across between the legs 58 of this yoke will be found pivot pin 60. Mounted upon this pivot pin 60 is a rocker arm 62. This rocker arm is mounted on pin 60 at a point between its ends for rockable movement to-and-fro between the full-line and the phantom line positions of FIG. 3 about an axis at its lower end defined by a second pivot pin 64. In this manner, the rocker arm defines a lever of the type having a fulcrum at one end thereof and one of the opposing forces located adjacent to the other end with the other opposing force located between the fulcrum and the other end of the lever. A post 66 projects rearwardly from the crossframe element 68 of the yoke 56 and it passes through an opening 70 in crossweb 72 of the frame as seen in FIG. 3. Between the rear face of the crossframe element 68 of the yoke 56 and the crossweb 72 of the frame is a compression spring 74. Movement of the rocker arm 62 between its full-line and phantom-line positions about pivot pin 64 causes the yoke to reciprocate back and forth thus alternately compressing and relaxing compression spring 74. It is significant to note that the upper end of the rocker arm is bifurcated as seen in FIGS. 1 and 2 to receive a roller 76 which rides along the rear face 78 of the block 44 and along the underside or bottom 80 thereof in a manner and for a reason which will be discussed below.

Also housed within the frame 48 between rails 54 is the trigger subassembly broadly referred to by reference numeral 82 and which includes the trigger 84 itself, the previously-identified cradle 36 that supports the rear end of the barrel, a forked sear member 86, a spring 88 and pivots 90 and 92. Trigger 84 is mounted for pivotal movement about a transverse axis between the full-line and the phantom line positions of FIG. 3 within the trigger slot 38 on pivot pin 90. In a similar manner, sear 86 is mounted for rockable movement at a point between its ends on pivot pin 92 that passes through the cradle 36. The bifurcated arms 94 of the sear extend rearwardly alongside the saddle as seen in FIG. 2 and fit into cutout portions 96 of the rails 54 of frame 48. As such, these arms when in the actuated or full-line position of FIG. 3, define continuations of the aforementioned rails 54 upon which the breech block 44 slides as it moves forward from the phantom-line position to pick up a shell from the magazine 14 and carry it forward into the shell chamber 46 where the breech block is shown in full lines. Alternately, in the cocked position of block 44 shown in phantom lines in FIG. 3, a pair of springs 88 resting in the bottom of the receiver function to bias the rear ends of the bifurcated arms upwardly and out of the plane of rails 54 (phantom line position) thus presenting transversely-spaced abutments blocking the forward movement of the block. This is also the phantom-line position of the trigger 84. When the trigger is pulled into its full-line position, the upwardly-facing ledge 98 located behind pivot pin 90 rotates counterclockwise around the latter and engages the front end of the sear thus raising its front end and lowering its rear end in opposition to the bias exerted thereon by the springs 88. As this takes place, the bifurcated arms 94 return to the full-line position shown in FIG. 3 lying in the plane of the rails 54 thereby removing the stops it provides that prevent forward movement of the breech block so that primary recoil spring 100 carried on spring-alignment rod 102 can push it forward into firing position.

As the breech block advances toward the shell chamber 46 driven by primary recoil spring 100, one of the first things that happens is that it will strip a shell 40 from the top of the magazine 14 as the longitudinally-extending rib 104 (FIGS. 3 and 5) projecting beneath the latter moves between opposed inturned tabs 106 in the top of the clip that hold the stack of shells in place against the spring-biased action of its follower that raises them up, all but the follower of which can be seen most clearly in FIGS. 1 through 3 and 5. As the top shell in the stack is stripped out of the magazine, either the follower underneath or the next shell in the stack defines a ramp which guides the shell into the chamber. The leading end of rib 104 carries the firing pin 116 which is in engagement with the head of the shell containing the primer. The breech block, advancing under the bias exerted on its rear end by both primary recoil spring 100 together with secondary recoil spring 74 which has become active in the interim, drives the firing pin into the primer contained in the head of the shell as it seats in the breech end of the barrel where the shell chamber 46 is located and stops. In so doing, of course, the shell fires in the conventional manner. It is significant to note that as the primary recoil spring 100 is extending and exerting less and less of a forwardly-propelling force against the breech block, the secondary recoil spring 74 reactivates and speeds up the return of the block into firing position.

The breech block has a longitudinally-extending opening 110 extending from end-to-end thereof as seen in FIGS. 3 and 4. The underside of this block is hollowed out part way back to form an arch-shaped pocket 112 seen most clearly in FIG. 5 which rides over and receives the top of the barrel 34 as the block advances to its full-line firing position, the firing pin 116 being positioned at the blind end of this pocket along with the rib 108 that strips the shell from the magazine and the extractors 114 and 116, seen best in FIGS. 1 and 5. Spring alignment rod 102 is loosely received in opening 110 and extends from the block 30 rearwardly all the way to the rear wall 20 of the receiver. Guiding of the block during its forward and rearward excursions is not a function of the spring alignment rod, but rather, the rails 54 and 94 in the bottom of the receiver, the sidewalls 24 and 26 of the latter and rails 118 (FIGS. 4 and 5) formed on the underside of the coverplate 28. Opening 110 is counterbored from the rear end of the block to a point spaced slightly behind its front end to enlarge same and provide a spring abutment shoulder 120 along with an annular space 122 around the spring alignment rod sized to receive primary recoil spring 100. Accordingly, as can be seen in FIG. 3, when the block moves rearwardly on its recoil stroke, the rod 102 remains fixed while the spring abutment shoulder compresses spring 100 coiled around the latter.

Digressing for a moment at this point, it is worthy of note that in those constructions where a single recoil spring-like spring 100 is used to absorb the recoil of the block, stop the latter and reverse the direction thereof before it strikes the rear endwall cushion 20B, the block would either have to be very light and have little mass, or the recoil spring would have to be very strong or very long resulting in the weapon itself being quite long. Unfortunately, especially in an automatic weapon, there is little choice left in the matter. For instance, if the block is heavy and a strong recoil spring is used to stop and reverse it in a short distance, it will cycle so rapidly that it becomes relatively impossible to extract and eject the empty shell casings and feed the unfired shells fast enough. Conversely, using a light block and a light recoil spring to stop and reverse it over a short distance not only does not solve the excessively rapid-firing problem, but more important, the block cannot withstand the muzzle pressure without blowing open prematurely. This is an especially acute problem with high power ammunition like the thin-jacketed .22 magnum cartridge.

By way of example of the above, a very popular machine gun is the so-called 9 mm UZI. It is well over 17 inches long and fires at a rate of about 650 rounds per minute. At this rate it can be controlled but requires a good deal of training to do so. Shortening the weapon to only 13 inches raised the firing rate to well in excess of 1500 rounds per minute and it could not be controlled by even an expert in rapid-fire weaponry. Accordingly, up to the present time, all such weapons having a single recoil spring use a rather massive block that travels over a long distance while the recoil is being dissipated and, therefore, an overly long weapon is the result; however, on the positive side, it is one that has a reasonable rate of fire and can be controlled.

Some mention has already been made of the rather unique problems associated with the present .22 magnum ammunition which is thin-walled and long besides using a slow burning powder. The slow burning powder becomes a factor because it is quite "dirty" when compared to fast burning powders meaning that it leaves a considerable residue inside the barrel. Space restrictions inside the barrel of a small caliber gun demand that any port for the purpose of bleeding off excess pressure be very small. The net result is that they clog up easily causing the gun to malfunction, often after firing only 30 or 40 rounds. The present inventor s two or multi-stage purely mechanical system obviates the difficulties associated with the gas-operated ones in a manner which will now be described in detail.

As previously noted, to keep the head of the .22 magnum cartridge from blowing off under the excessive muzzle pressure produced by this ammunition, it is essential that the breech remain closed until the muzzle pressure has reduced to a level far below that which ordinary thick-walled ammunition could withstand without rupturing. The inventor accomplishes this purely mechanically in accordance with the teaching of the instant invention by the simple expedient of supplementing the bias exerted by the primary recoil spring 100 with the previously-described secondary recoil subassembly while taking full advantage of the mass of the breech block itself and that additional force required to set it in motion from an "at rest" position, to hold it closed momentarily. Functionally, the roller 76 is held against the rear end of the block while it is seated against the breech holding the unfired shell therein by means of a secondary recoil subassembly spring having a spring constant selected to cooperate with the starting inertia required to get the block moving and with the primary recoil spring 100 effective to hold the block closed momentarily but long enough for the muzzle pressure to dissipiate to a level at which the head of the spent cartridge will not blow off, whereupon, the remaining pressure is still sufficient to open the block against the combined bias of both springs 74 and 100. It is noted that the cooperation between the spring forces and the force required to get the block moving are selected such that the reactive forces associated with the firing of the cartridge are insufficient to move the block away from the breech until the pressure drops to the desired level while, at the same time, leaving sufficient residual pressure in the system to retract the block against the combined force exerted by both the primary and secondary recoil absorption systems once the resting inertia of the latter has been overcome. The two acting together over a portion of the recoil stroke slow down the block considerably faster than the primary spring could do alone thus resulting in a much shorter travel of the block and a correspondingly shorter overall weapon. With the added bias of the secondary spring 74 helping to hold the block closed, a somewhat light block can be used and still retain the high muzzle pressure.

Now, another important aspect of the two-stage spring-biased recoil mechanism of the present invention is the deactivation of the entire secondary spring-biased recoil subassembly after a predetermined rearward travel of the breech block. This deactivation occurs when the roller 76 rolls off the rear end of the block and down underneath it where only minimal rolling frictional resistance is offered to its further movement. In other words, once the secondary recoil subassembly has performed its functions of initially assisting the primary one in momentarily holding the block closed until the excessive muzzle pressure has dissipated to a level where the breech can be safely opened without the shell case disintegrating and thereafter cooperates in the same way with the primary system to slow down the rearward travel of the breech block as it extracts and ejects the spent shell casing while at the same time absorbing enough of the recoil so that what remains can be absorbed by the primary system alone, then the secondary system becomes essentially inoperative and the primary system takes over. By so doing, the secondary subassembly is not functioning to return the block into firing position so quickly that it speeds up the rate of fire beyond that which can easily be accommodated and the gun controlled even though on the forward stroke of the block the secondary recoil subassembly becomes operative again to speed up the return of the block into firing position at the time it needs extra "push" to pick up a new shell and shove it into the chamber. Thus, even though the overall length of the weapon is considerably shorter than other automatic weapons using only one recoil spring, its rate of fire is no faster and it is fully controllable. As a matter of fact, while the specific reason for this is, as yet, unknown, the secondary recoil subassembly in some way cancels out much of the tendency of automatic weapons to rise as they are fired. Skilled shooters of rapid-fire weapons were able to shoot tighter groups with the unit forming the subject of the present invention than other comparable ones using the same ammunition.

It is important to note that while the two-stage recoil assembly described above has special significance in connection with the use of the .22 caliber magnum ammunition because of its thin-walled casing and large charge of powder in comparison to other .22 caliber cartridges, it also is applicable to other weapons like, for example, the aforementioned UZI which can be made much shorter, more compact and probably a good deal easier to control as well as being more accurate by adding the present secondary recoil subassembly to the conventional primary one. As a matter of fact, the staged recoil absorption system of the present invention is readily adaptable for use in more conventional firearms even shotguns, although it reaches the pinnacle of its utility on automatic weapons firing thin-walled magnum ammunition.

Of considerable practical importance, and equally applicable to other rapid-fire and weapons, otherwise, is the unique design of the gun which allows the block, the primary stage of the two-stage recoil assembly and the extractor mechanism to be taken out as a unit once the coverplate is removed. This can be done very quickly and the whole assembly replaced with a new or reconditioned one thereby placing the weapon back in operation immediately while the worn or defective parts are serviced. In combat, for example, an infantryman might even carry a spare.

Figure 5:
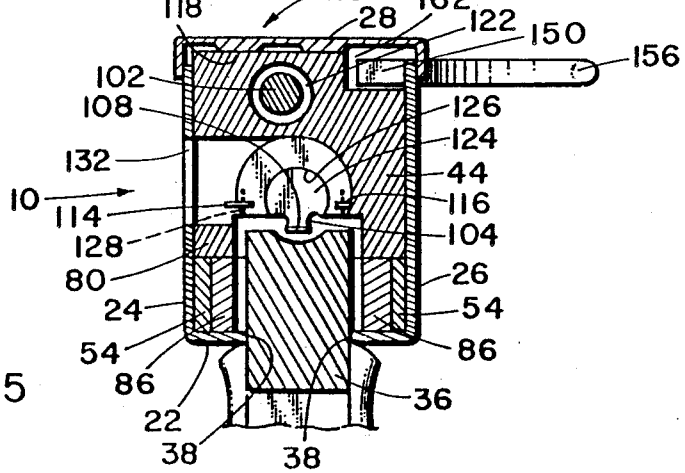
FIG. 5 is a section taken along line 5—5 of FIG. 3 but to a much larger scale than the other figures.

The extractors 114 and 116 are mounted above the firing pin 108 alongside the insert 124 in the bottom of the block that carries the latter as seen in FIGS. 3 and 5. This insert is cylindrical and is held by a pin (not shown) within a longitudinal bore 126 running along the bottom of the block. Obviously, a broken firing pin becomes a simple matter to replace since it is an integral part of insert 124 which can be removed from the block and replaced in a minute or so.

Extractors 114 and 116 are pivotally mounted on pins 128 for movement between a spread position shown in FIG. 2 and a closed position shown in FIGS. 3 and 5. A spring 130 located in the insert normally biases the extractors into their closed position. Extractor 116 located on the side of the block opposite spent case discharge opening 132 in the right sidewall 24 of the receiver has the inside edge thereof shaped to provide a forwardly and outwardly-curved cam surface 134L (FIG. 2) that engages and rides up over the head 136 of the shell casing thus moving from its closed into its spread position. Extractor 114, on the other hand, lies adjacent to the spent case discharge opening 132 within cutout 138 (FIGS. 2 and 5) in the right side of the block and has its inside edge provided with a similar forwardly and outwardly-curved cam surface 138 that includes a notch cooperating therewith to define a hook 140. Its inclined surface 134R, like the analogous one 134L on the other extractor, rides up along the head 136 of the shell casing thus moving into its spread position when the latter enters the breech and sits in the chamber 46, however, as the breech block closes and the firing pin enters the cartridge to fire it, the hook 140 seats behind the head of the shell casing as it comes back in slightly under the influence of spring 130 and comes to rest upon the generally frustoconical surface 142 at the rear end of the barrel bordering the breech. There is just enough of the casing that extends out laterally beyond this rear end of the barrel for the hook 140 to hook behind the head 136 and pull the cartridge out of the chamber, fired or not, as the block retracts. In other words, the muzzle pressure does not back the cartridge out of the chamber into a position where the extractors can pick it up because if this were necessary, it would not be possible to eject a cartridge that had misfired. The function of the extractor 116 is to hold the head of the cartridge hooked in the hook 140 of extractor 114 when the case is pulled rearwardly and no longer confined by the chamber against sideways movement. As the block travels back on its recoil stroke with the empty case or unfired cartridge, whichever is present, the edge of the latter nearest extractor 116 will strike the front inside corner of still another inturned tab 144 atop the magazine which projects above the cartridge-retaining tabs 106. Tab 144 forms a fixed abutment which functions to cause the lefthand extractor to spread and move aside thus stripping the shell therefrom. Meanwhile, the right side of the head 136 is still hooked behind hook 140 of righthand extractor 114 which acts as a fulcrum as it continues to move rearwardly relative to the abutment defined by tab 144 and swings the shell or its case to the side and out through spent case discharge opening 132 where it unhooks and drops free, all of which is clearly revealed in FIG. 2.

In FIG. 1, it can be seen that a tension spring 146 attached at one end to ear 148 located at the front of the coverplate 28 on the underside thereof has is other end secured to block cocking lever 150. This lever extends all the way to the rear end of the receiver where it emerges through an opening 152 in the rear endwall 20 and is provided with a fingerhold 156. On the front end of this same lever adjacent to where the spring is hooked is an integrally-formed ear 158, the rear edge of which engages a forwardly-facing shoulder 160 on the side of the breech block as seen in FIG. 2. Pulling rearwardly on the cocking lever against the bias exerted by tension spring 146 causes the block to move back into its cocked phantom-line position shown in FIGS. 1 and 3 where the arms 94 of the sear 86 spring up in front of it. Once cocked in this manner, the cocking lever can be released to return forwardly into its full-line position. Movement of the cocking lever is confined to milled slot 162 in the top of the breech block and the underside of the coverplate.

A rapid-fire weapon with a barrel this short and high-powered ammunition is so noisy it cannot be fired without some sort of protection for the ears. This being the case, the particular form of the weapon illustrated in FIGS. 1, 2 and 3 shows a conventional silencer 164 attached to the barrel.

Certain other embodiments of the recoil system forming the subject matter of the present invention are shown in FIGS. 6–14 to which detailed reference will next be made. These other embodiments are both used in conjunction with a reciprocating breech block and a primary recoil absorption system of the general type already illustrated and described in detail in connection with FIGS. 1–5, inclusive; therefore, in order to avoid unnecessary duplication, these same mechanisms will not be described again although the major components thereof carry the same reference numerals assigned to them previously.

Referring next to FIGS. 6–10, a secondary recoil absorption subassembly broadly designated by reference numeral 50' has been illustrated which differs from that subassembly 50 of FIGS. 1–5 in that is consists of two successive stages of recoil absorption instead of just one. In other words, while the embodiment of FIGS. 1–5 encompassed a total of two stages of recoil absorption, one comprised of subassembly 50 and the other the primary recoil absorption subassembly, this one has a total of three, two of which are encompasses in subassembly 50 and the third being the conventional primary subassembly. An overview of FIGS. 6–10, particularly the latter three figures, will immediately reveal the fact that this embodiment effectively "doubles-up" the secondary recoil absorption subassembly and brings the breech block to a stop before reversing its direction in three successive increments instead of two. In the first, just the forwardmost and the conventional primary subassemblies are active to slow down the block at which point it is under the influence of the greatest of the reactive forces generated by the exploding cartridge. As this force diminishes in intensity, the first of the subassemblies drops out and the second becomes operative while the primary one remains active. Finally, the second of the three becomes inoperative, whereupon, the primary system takes over and finishes the job of slowing the block to a stop and reversing its direction. Then, once again, on the return stroke, the second subassembly rejoins the primary one to accelerate the block as the spring bias exerted by the latter begins to diminish and the unfired cartridge is picked up from the magazine. Next, the second drops out and the third of the three joins the first with the two now active to continue speeding the block along its way to push the shell into the chamber.

Figure 7:
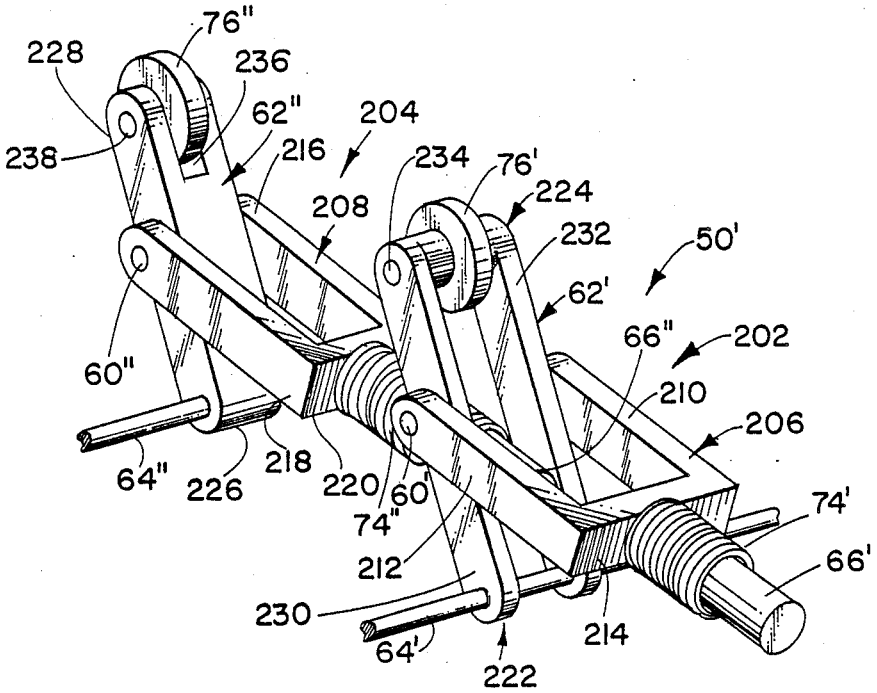
FIG. 7 is a fragmentary perspective view to a somewhat larger scale showing the three stage version of FIG. 6.

The modified secondary recoil subassembly 50' is, perhaps, most clearly revealed in FIG. 7 where it will be seen to be further subdivided into a pair of subassemblies 202 and 204 which are spaced one behind the other in the direction of breech block travel as the latter moves rearwardly. Both of these subassemblies 202 and 204 include U-shaped yokes which have been identified by reference numerals 206 and 208, respectively, and both of which open forwardly. Yoke 206 includes transversely-spaced legs 210 and 212 connected together at their rear ends by crossframe element 214 analogous to element 68 in FIG. 3. In similar fashion, yoke 208 has spaced-apart legs 216 and 218 interconnected by crossframe element 220.

Extending transversely between the free ends of the aforementioned legs of each yoke is a pivot pin 60' seen with yoke 206 and one 60" for yoke 208. Rocker arms 62' is mounted intermediate its lower and upper ends 214 and 216, respectively, on pivot pin 60' for rockable movement from its forwardmost position shown in FIGS. 6–9 and its rearwardmost position shown in FIG. 10. It will be seen in FIG. 7 that the rocker arm 62' of the rear subassembly 202 is bifurcated to receive certain elements soon to be described of the front subassembly 204. In a similar manner, the rocker arm 62" of the front subassembly 204 is mounted for rockable movement at a point intermediate its lower end 226 and upper end 228 on pivot pin 60". The movements of the latter rocker arm between its forwardmost position shown in FIGS. 6–8 and its rearwardmost one shown in FIGS. 9 and 10 is quite analogous to the movement of rocker arm 62 shown in full and phantom lines in FIG. 3.

The axes of pivotal movement of rocker arms 62' and 62" are defined by pivot pins 64' and 64", respectively, which are mounted in the bottom of the housing in position to pass through their lower ends 222 and 226 as seen in FIG. 7, once again, much in the same manner as pivot pin 64 in FIG. 3. Posts 66' and 66" project rearwardly from the crossframe elements 214 and 220, respectively, of the front and rear yokes where they pass through enlarged openings in transversely-extending spring abutments like the one shown at 72' in FIG. 6. A second such apertured abutment which receives the front post 66" is not shown, however, it is similar to the one shown at 72' in FIGS. 1, 2 and 3. Mounted between the crossframe elements of each yoke and these abutments are the compression springs 74' and 74". As alluded to previously, rocker arm 62' is bifurcated to define spaced apart legs 230 and 232 which pass alongside the post and spring of the front subassembly 204. A pin 234 extends transversely between the aforementioned legs of rocker arm 62' mounting roller 76' for rotational movement. Rocker arm 62" of the front subassembly 204, on the other hand, is shown made of one-piece construction but slotted at it upper end 228 to receive the roller 76" which is mounted on pin 238.

From a functional standpoint, the action of the front subassembly 204 is analogous to that of the single secondary subassembly 50 of FIGS. 1–5. By the same token, so is that of the rear subassembly 202 except that it performs no function in terms of holding the block closed against the breech while the muzzle pressure is degenerating to a level at which the breech can be safely opened. In other words, once the block has moved away from the breech, the retardant functions performed by subassemblies 204 and 202 are the much the same were it not for the fact that they can differ in magnitude and thus provide a dimension of breech block control that cannot be achieved using the front one and the primary system alone. Specifically, it is advantageous to have spring 74" on the front subassembly 204 a good deal stronger than spring 74' on the rear one 202. During the retraction stroke of the block, the front subassembly 204 will be active holding it closed against the breech and cooperating with the primary system to slow down and absorb the reactive forces at the time they are the greatest. Once these excessive forces have been handled and they have dropped down to a more reasonable level, then the relatively weaker back-up system defined by subassembly 202 can take over and cooperate with the primary one to finish the job. Such a "division in work" becomes even more significant on the return stroke where the final "push" necessary to propel the fresh round into the chamber requires the greatest impetus. It is at this time that subassembly 204 with its relatively stronger spring takes over the job for the weaker one 202 and, in cooperation with the primary system which at this point is even weaker, completes the firing cycle. This is not to say, of course, that subassemblies 202 and 204 cannot be alike or even that the rear one 202 cannot be stronger than the one in front, 204; however, there appear to be certain advantages in making the front one the stronger of the two.

Figure 8:
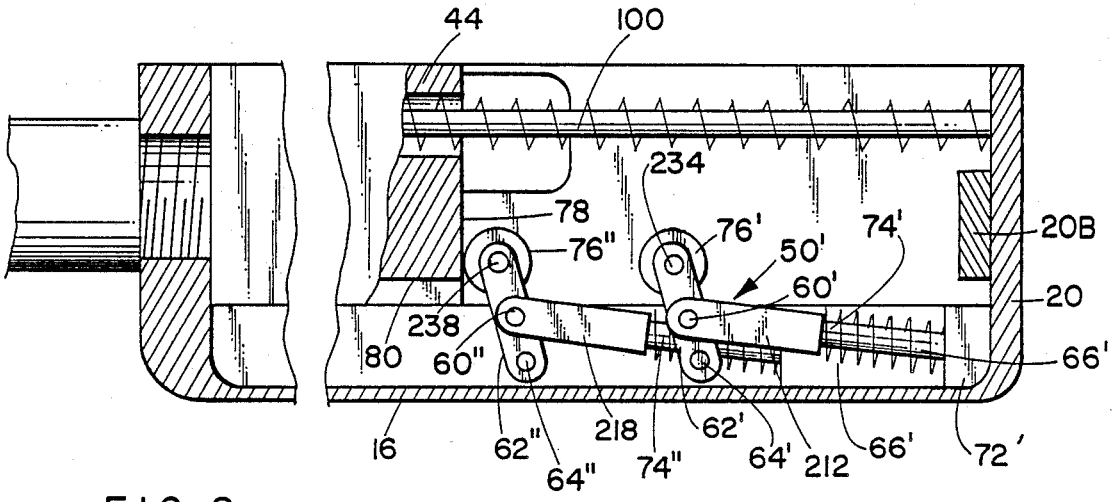
FIGS. 8, 9 and 10 are fragmentary elevational views similar to FIG. 3, but to a larger scale, showing the recoil portion of the firing cycle of the three stage subassembly of FIG. 6 and 7.
Figure 9:
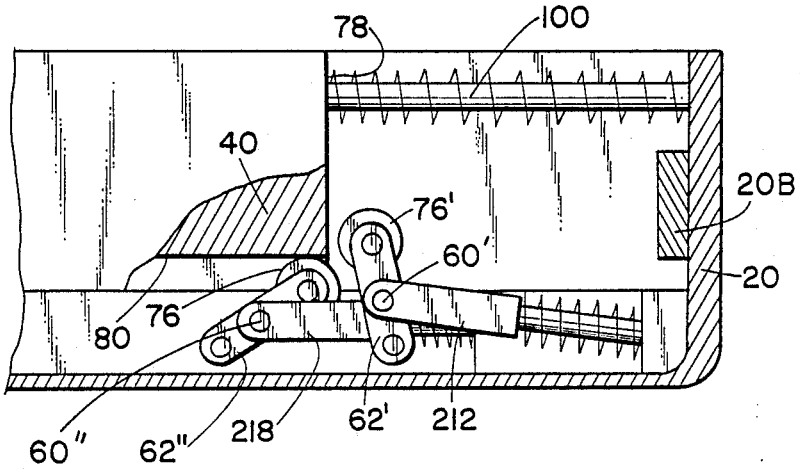
Figure 10:
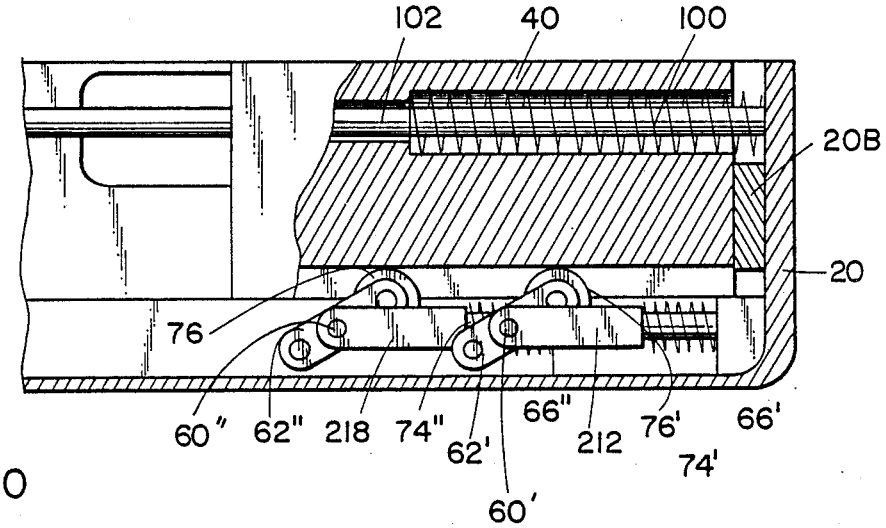

FIGS. 8, 9 and 10 show in detail the recoil segment of the firing cycle. As already noted, front subassembly 204 is performing essentially the same function it did in the embodiment of FIGS. 1–5 in cooperation with the primary recoil absorption system while the rear subassembly 202 remains inactive. In FIG. 9, it can be seen that the front subassembly 204 has already dropped out and the rear subassembly 202 is about to take over. Finally, in FIG. 10, both subassemblies 202 and 204 of secondary system 50' have dropped out leaving the remaining recoil to be absorbed by the primary system.

Before proceeding with the second of the modifications shown in FIGS. 11–14, it should be mentioned that by merely providing a step or recess in the underside of the block such that *both* rollers 76' and 76" can engage it simultaneously, then the front and rear subassemblies will function on concert with one another and with the primary system rather than sequentially as shown in FIGS. 8, 9 and 10. There are, however, certain disadvantages in so doing in that, in most instances, the breech block will have to be made longer thus lengthening the entire weapon. A far better and more practical solution to providing greater recoil resistance and block slow-down at the beginning of the recoil cycle as well as accelerated shell insertion at the end thereof, all without lengthening the block, is found in the modification shown in FIGS. 11–14 to which detailed reference will now be made.

Here, instead of the secondary recoil absorption system consisting of a pair of subassemblies 204 and 202 located one behind the other as in FIGS. 6–10 so as to operate sequentially, two identical subassemblies are placed such that they both act simultaneously by pushing against the rear face of the block but, upon becoming inactive, they move over onto different faces of the latter that essentially parallel its direction of movement. As illustrated, they move from the rear over onto opposite sides of the latter. Obviously, they could do the same on the top and bottom or, conceivably the top or bottom and one side. Mounting of these subassemblies on opposite sides of the block, however, has certain advantages and is preferred in that, generally speaking, the housing can be made somewhat wider, at least in the area where the secondary recoil system is located, without interfering with other necessary elements. If, on the other hand, a part of the subassembly has to go on top of the weapon, sighting may be interfered with, etc.

Figure 11:
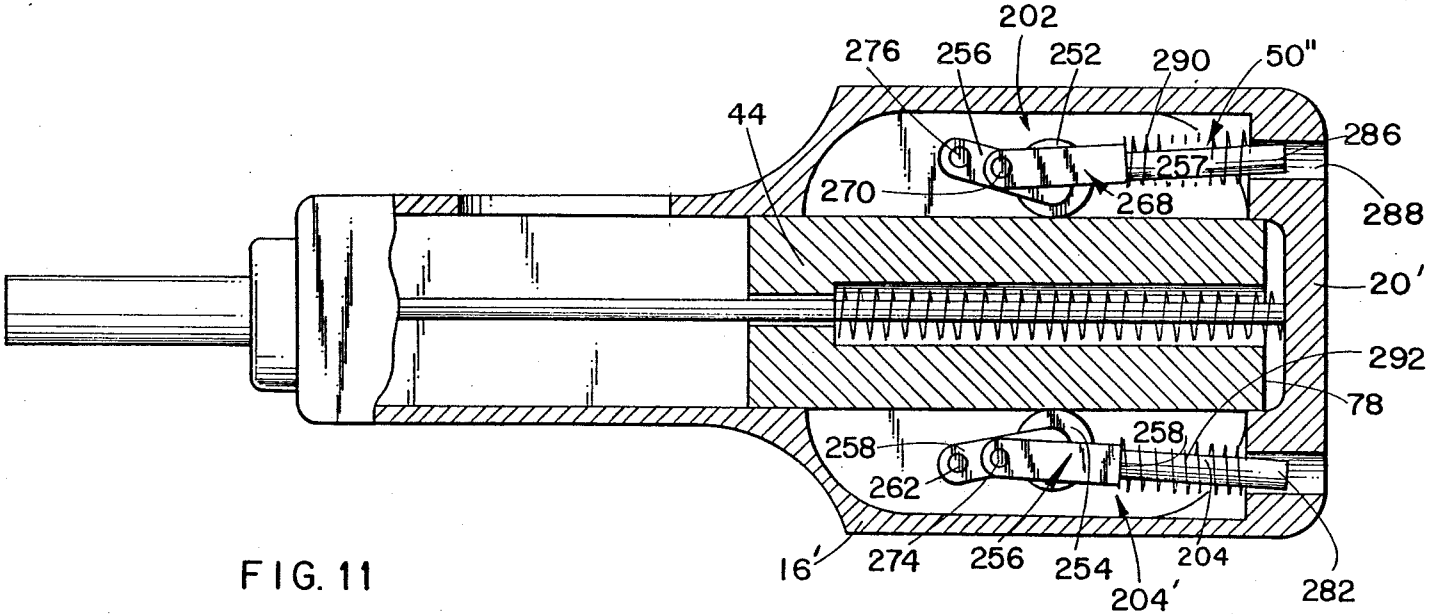
FIG. 11 is a fragmentary top plan view similar to FIG. 6 but to a slightly larger scale, and also having portions broken away and shown in section, directed to another two stage spring-biased recoil absorption subassembly which differs from that of FIGS. 1–5 in that it doubles-up the spring bias exerted during the second and fifth breech block control stages.
Figure 12:
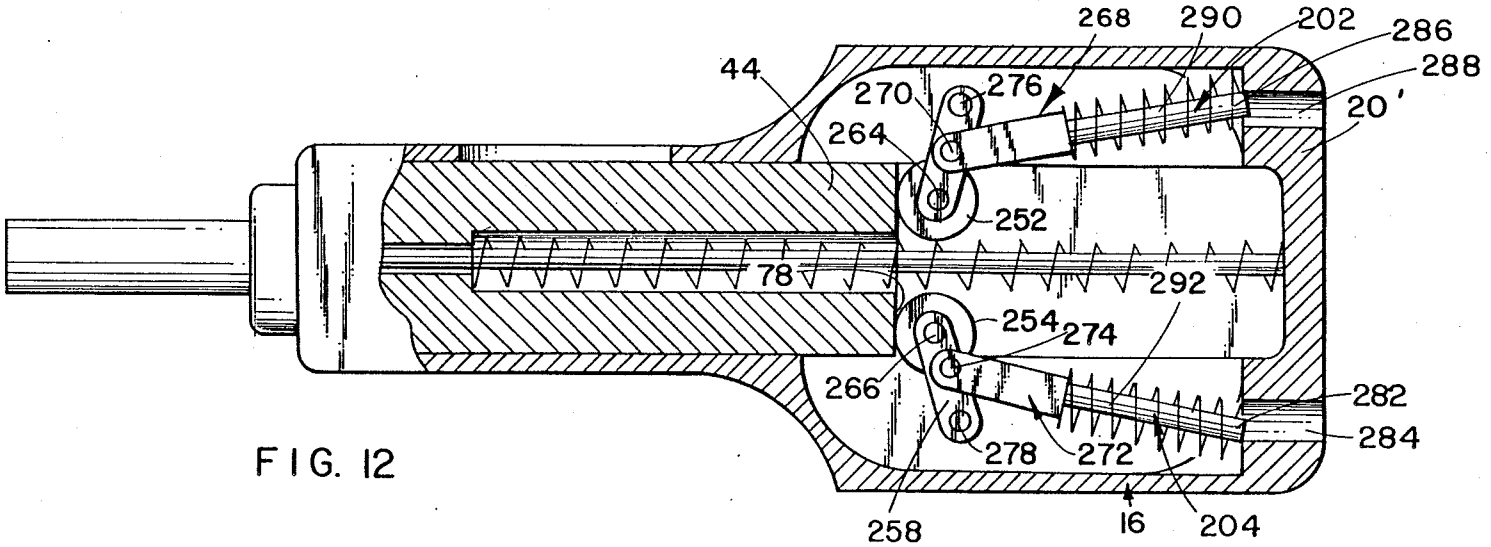
FIG. 12 shows the last half of the firing cycle in which the breech block is accelerated forward by the two-stage subassembly of FIG. 11; and, FIGS. 13 and 14 are fragmentary side elevational views with portions broken away to show the breech block return sequence of FIGS. 11 and 12 from the side.
Figure 13:
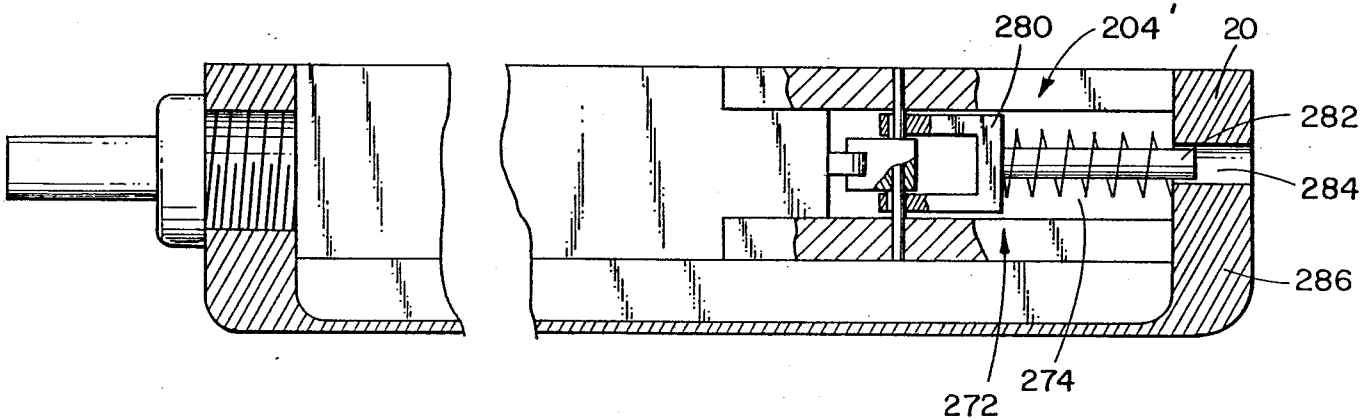
Figure 14:
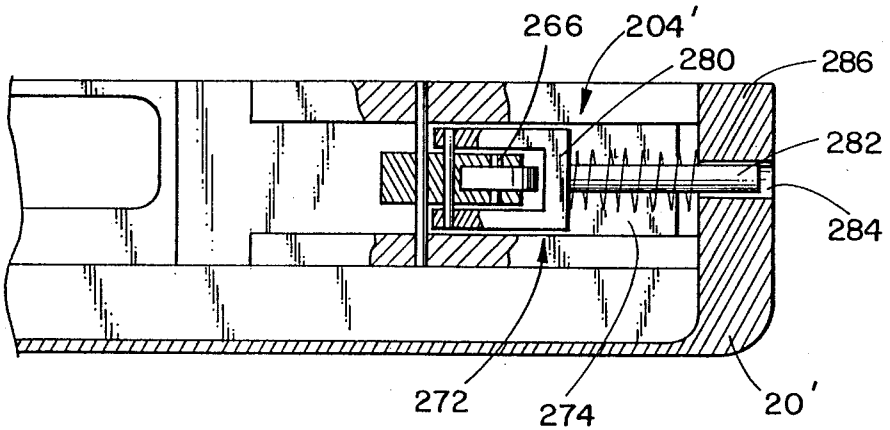

This embodiment 50" includes right and left subassemblies 202' and 204', respectively, which are mounted in transversely spaced relation alongside the block 44 as opposed to one behind the other. Roller 252 mounts on rocker arm 256 which is a part of the right subassembly 202 while, in a similar fashion, roller 254 and its rocker arm 258 comprise elements of the left one 204'. Roller 252 is mounted for rotation on its arm 256 by means of pin 264 seen in FIG. 12; whereas, in a similar manner, roller 254 of the lefthand subassembly is mounted for rotation on rocker arm 258 by means of pin 266 seen in both FIGS. 12 and 14. A yoke 268 is pinned at 270 to rocker arm 256 intermediate its ends while a yoke 272 is similarly pinned to rocker arm 258 by means of pin 274. The end of rocker arm 256 opposite the mounting roller 252 is mounted for pivotal movement about a vertical axis extending along the righthand side of the block defined by pin 276. In a similar manner on the lefthand side of the block, the end of rocker arm 258 opposite that carrying roller 254 is mounted for pivotal movement on pin 278 as shown. Extending rearwardly from the crossbar portion 280 of the lefthand yoke 272 is a post 282 which is received in oversize aperture 284 in the rear wall 20' of the housing. In like manner, post 286 is fastened to the crossbar of yoke 268 in position to project rearwardly through oversize opening 288 in rear housing wall 20' as seen in FIGS. 11 and 12. This wall and the crossbar portions of the yokes define the spaced abutments for compression springs 290 and 292, respectively, that fit over the posts of the right and lefthand subassemblies 202' and 204', respectively.

The operation of both of these side-by-side subassemblies is, of course, essentially the same as that of the single one forming the subject matter of FIGS. 1–5 except that the two (202' and 204') work together to both hold the block 44 closed against the breech and to retard the initial thrust of the block as it begins to move away from the breech with the empty shell casing during the retraction stroke of the firing cycle. In like manner, these two cooperate on the return stroke of the block when it is picking up a new shell for insertion into the chamber to speed up this phase of the firing cycle. Both subassemblies, in the particular form shown, drop out at the same time during the retraction stroke and also resume their block-speed-up function simultaneously on the return stroke; however, this need not be the case and by simply changing the length of one of the rocker arms, changing the relative sizes of the rollers or relocating the pivots, or all three, one subassembly can be made to drop out and reengage at a different time than the other although it would seem that no useful purpose would be served by so doing.

This modification of FIGS. 11 through 14 is ideally suited for use in those applications like, for example, shotguns, which have a great deal of recoil, heavy shells and other complexities that oftentimes demand the extra power of two such subassemblies 202' and 204' working together that cannot be satisfactorily supplied by a single secondary spring biased recoil subassembly like that of FIGS. 1–5 equipped with a heavier spring. On the other hand, space considerations alone may dictate the use of two smaller and lighter-duty subassemblies versus a single heavy-duty one that requires more room.

Finally, those skilled in the art will readily ascertain from what has been disclosed herein that other combinations of secondary recoil absorption systems can be devised which cooperate with the primary system to control movement of the breech block during a portion of its excursion both rearwardly and forwardly while permitting the primary one to operated all by itself as it slows the block to a stop and reversed its direction.

What is claimed is:

1. In a firearm of the type having a frame and a receiver, a barrel mounted on the fame and having a shell-receiving chamber with a breech that is located adjacent to a rear end of the barrel, the shell-receiving chamber including a mouth on a front end thereof into which a shell is inserted for firing with shell firing imparting recoil energy into the breech and producing an empty shell casing, means for extracting the empty shell casing from the breech and means for positioning a new shell for insertion into the breech, a block having sidewalls and a front end and a rear end housing within the receiver for reciprocating movement along a path between a closed position with said front end seated against the breech and a retracted position uncovering the breech, with the empty shell casing being extracted from the breech as said block moves from said closed position to said retracted position and the new shell being inserted into the breech as said block moves from said retracted position to said closed position, and a primary recoil absorption means including a spring normally biasing the block into said closed position operative during a retraction stroke thereof to absorb at least a portion of recoil energy associated with firing of said shell while the empty shell casing is being extracted and during a return stroke to force said block into contact against the new shell to pick up that new shell and force same into the shellreceiving chamber, the improvement in combination therewith comprising: secondary recoil adsorption measn which immediately after firing is in movement-controlling connection with said block during a time the empty shell is being extracted and cooperates with the primary recoil absorption means to slow down the retraction stroke of the block as it moves away from the breech and then after the empty shell has been extracted becomes essentially inactive with respect to controlling movement of said block and then prior to the new shell being contacted by the breech block for insertion into the breech reengages into movement-controlling contact with said block and once again cooperates with said primary recoil absorption means and speeds up the return stroke of said block to a speed which is faster than that speed attainable under an influence of the primary recoil absorption means alone to assist the primary recoil absorption means during the picking up of the new shell and forcing it into the breech, said secondary recoil absorption means including at least a first lever-actuating means mounted on the frame adjacent to the block for movement towards an extended position when moving in a direction which is identical to that in which said block moves during the return stroke thereof and towards a retracted position when moving in a direction which is identical to that in which said block moves during said retraction stroke, a first spring means connected to the first lever-actuating means normally biasing same into said extending position, means comprising a first lever arm having an antifriction means mounted thereon, said first lever arm being connected to said first lever-actuating means and to the frame for pivotal movement between a substantially upright operative position in engagement with the rear end of the block yieldably resisting movement of the latter into said retracted position and a reclining inoperative position alongside a sidewall of said block, said first spring means cooperating with the first lever-actuating means and the first lever arm when said first lever arm is in said upright operative position in engagement with the rear end of said block to assist the primary recoil absorbing means in slowing down movement of said block as it moves away from the breech, said first lever arm and said first lever-actuating means and any recoil energy left in said block next cooperating with one another when said block is partially retracted to overcome bias exerted by said first spring means and move said first lever arm with said antifriction means out of contact with the rear end of said block and to move said first lever arm into said reclining inoperative position alongside said sidewall of the block such that any recoil energy remaining in the block when the first lever actuating means moves into said reclining inoperative position is absorbed solely by the primary recoil absorption means, said primary recoil absorption means being solely operative thereafter to terminate the retraction stroke of said block and start said block on said return stroke, and said first spring means finally cooperating with the first lever-actuating means and the first lever arm after said block has progressed part way along its return stroke under bias imparted thereto by the primary spring recoil absorption means to reactivate said secondary recoil absorption means by returning said first lever arm into said upright operative position and said antifriction means in contact with the rear end of said block thereby assisting said primary recoil absorption means to push and speed the block into said closed position against the breech 2. The improvement as set forth in claim 1 in which: the first lever-actuating means is mounted for movement between said extended and retracted positions alongside a first side of the block and, in which the secondary recoil absorption means also includes a second lever-actuating means mounted for movement alongside a second side position of said block between an extended position moving in the same direction as that in which said block moves during the return stroke thereof and a retracted position moving in a direction which is identical to that in which said block moves during said retraction stroke, a second spring means connected to the second lever-actuating means normally biasing same into its extended position, and means comprising a second lever arm connected to said second lever-actuating means and to the frame for pivotal movement between an inoperative position alongside said second side position of said block and an operative position in engagement with the rear end of the block 3. The improvement as set forth in claim 1 in which: the first lever-actuating means is mounted for movement between said extended and retracted positions alongside one side of the block and, in which the secondary recoil absorption means also includes a second lever-actuating means mounted in spaced relation behind said first lever - actuating means for independent movement between extended and retracted positions, a second spring means connected to the second lever-actuating means normally biasing same into its extended position, and means comprising a second lever arm connected to said second leveractuating means and to the frame for pivotal movement between an inoperative position alongside said one side of the block and an operative position adapted to engage said yieldably resist movement of said block into said retracted position in sequential time-delayed relation when said first lever arm has moved to said inoperative position.

4. The improvement as set forth in claim 1 in which: the lever arm is attached to the frame at one end thereof, and the first lever-actuating means is pivotally attached to the first lever arm intermediate ends of the lever arm.

5. The improvement as set forth in claim 1 in which: the antifriction means comprises a roller positioned and adapted upon movement of said lever arm into a lever arm retracted position to roll along the rear end of the block and off the later onto the sidewall thereof.

6. In a method of controlling a firearm having a frame and a receiver, a barrel mounted on the frame and having a shell-receiving chamber with a breech that is located adjacent to a rear end of the barrel, the shell-receiving chamber including a mouth on a front end thereof into which a shell is inserted for firing, a block having sidewalls and a front end and a rear end housed within the receiver for reciprocating movement between a closed position with its front end seated against the breech at the mouth of the shell-receiving chamber and a retracted position uncovering the breech, and a primary recoil absorption means including a spring normally biasing the block into said closed position operative during a retraction stroke thereof to absorb at least a portion of any recoil energy associated with firing of the shell while extracting an empty shell casing and during a return stroke to pick up an unfired shell and insert same into the shell-receiving chamber, the improved method for use in combination therewith for controlling a firing cycle of said block comprising: activating a secondary spring-biased recoil absorption means for initially cooperating with the primary recoil absorption means to slow down the retraction stroke of the block as it moves away from the breech during a first predetermined time interval of its retraction stroke, deactivating said secondary spring-biased recoil absorption means following a lapse of said first predetermined time interval for a second time interval during which the primary recoil absorption means has slowed the bolt to a stop and reversed its direction, and thereafter reactivating said secondary spring-biased recoil absorption means prior to picking up an unfired shell so as to cooperate with said primary recoil absorption means in speeding up return of said block to the closed position.

7. The improvement as set forth in claim 6 in which: the first predetermined interval takes place at a beginning of the retraction stroke of the block.

8. The improved method as set forth in claim 6 in which: a first predetermined portion of the return stroke of the block wherein the primary and secondary recoil absorption means cooperated to speed up return movement of said block takes place near an end of the return stroke of the latter.

9. The improved method as set forth in claim 8 in which: said block picks up an unfired shell and inserts same into the firsting chamber during a predetermined portion of the return stroke.

10. The improved method as set forth in claim 6 in which: the secondary spring-biased recoil absorption means accomplishes the slow down of the block in cooperation with the primary recoil absorption means during the first predetermined time interval in at least two successive stages, and in which said secondary spring-biased recoil absorption means accomplishes speed up of return of the block in cooperation with said primary recoil absorption means in at least two successive stages.

11. The improved method as set forth in claim 6 in which: the secondary spring-biased recoil absorption means is subdivided into two independent spring-biased subsystems activating said two independent spring-biased subsystems simultaneously with one another and with the primary recoil absorption means during both the first predetermined time interval and a second predetermined time interval during the return stroke following the reversal in the direction of block movement accomplished by said primary recoil absorption system acting unaided by said secondary recoil absorption means.

12. The improvement method as set forth in claim 6 in which: the first predetermined time interval is substantially less than a total period required for the block to move through said retraction stroke and a second predetermined time interval during which the primary and secondary recoil absorption means are cooperating to return said block to its original position is less than a time required for said block to complete said return stoke.

13. The improved method as set forth in claim 6 in which: said secondary spring-biased recoil absorption means is operative during the return stroke of said block for a pre-selected time interval, and said first predetermined time interval is less than said pre-selected time interval.

14. The improved method as set forth in claim 6 in which: the block travels a first prescribed distance during said retraction stroke and a second prescribed distance during said return stroke while the secondary spring-biased recoil absorption means is inoperative, with said first and second prescribed distances being substantially the same.

15. The improved method as set forth in claim 6 in which: the block travels a first prescribed distance during its retraction stroke and a second prescribed distance during its return stroke while the secondary spring-biased recoil absorption means is inoperative, with said first and second prescribed distances being substantially the same.

16. The improved method as set forth in claim 6 in which: the first predetermined time interval takes place during a time in which the block is extracting and ejecting the empty shell from the firing chamber.

17. In a firearm of the type having a frame and a receiver, a barrel mounted on the frame and having a shell-receiving chamber with a breech that is located adjacent to a rear end of the barrel, the shell-receiving chamber including a mouth on a front end thereof into which a shell is inserted for firing with shell firing imparting recoil energy into the breech and producing an empty shell casing, means for ejecting the empty shell casing from the breech and means for positioning a new shell for insertion into the breech, a block having sidewalls and a front end and a rear end housed within the receiver for reciprocating movement along a path between a closed position with said front end located against the breech and a retracted position uncovering the breech, with the empty shell casing being ejected from the breech as said block moves from said closed position to said retracted position and the new shell being inserted into the breech as said block moves from said retracted position to said closed position, and a primary recoil absorption means including a spring normally biasing the block into said closed position operative during a retraction stroke thereof to absorb at least a portion of a recoil energy associated with firing of said shell while the empty shell casing is being ejected and during a return stroke to pick up that new shell and force same into the shell-receiving chamber, the improvement in combination therewith comprising: secondary recoil absorption means which immediately after firing is in movement-controlling connection with said block during a time the empty shell is being ejected and cooperates with the primary recoil absorption means to slow down the retraction stroke of the block as it moves away from the breech and then after the empty shell has been ejected becomes essentially inactive with respect to controlling movement of said block and then prior to the new shell being contacted by the breech block for insertion into the breech reengages into movement-controlling contact with said block and once again cooperates with said primary recoil absorption means and speeds up the return stroke of said block to a speed which is faster than that speed attainable under an influence of the primary recoil absorption means alone to assist the primary recoil absorption means to pick up the new shell and force it into the breech, said secondary recoil absorption means including a first lever-actuating means mounted on the frame adjacent to the block for movement towards an extended position when moving in a direction which is identical to that in which said block moves during the return stroke thereof and towards a retracted position when moving in a direction which is identical to that in which said block moves during said retraction stroke, a first spring means connected to the first lever-actuating means normally biasing same into said extended position, means comprising a first lever arm having an antifriction means mounted thereon, said first lever arm being connected to said first lever-actuating means and to the frame for pivotal movement between an upright operative position to have said antifriction means in engagement with the rear end of the block yieldably resisting movement of the latter into said retracted position and an inoperative position alongside a sidewall of said block, said first spring means cooperating with the first lever-actuating means and the first lever arm when said first lever arm is in said upright operative position with said antifriction means in engagement with the rear end of said block to assist the primary recoil absorption means in slowing down movement of said block as it moves away from the breech, said first lever arm and said first lever-actuating means and any recoil energy left in said block next cooperating with one another when said block is partially retracted to overcome bias exerted by said first spring means and move a first lever arm antifriction means out of contact with the rear end of said block and to move said first lever arm into said inoperative position alongside said sidewall of the block such that any recoil energy remaining in the block when the first lever actuating means moves into said inoperative position is absorbed solely by the primary recoil absorption means, said primary recoil absorption means being solely operative thereafter to terminate the retraction stroke of said block and start said block on said return stroke, and said first spring means finally cooperating with the first lever-actuating means and the first lever arm after said block has progressed part way along its return stroke under bias imparted thereto by the primary spring recoil absorption means to reactivate said secondary recoil absorption means by returning said first lever arm into said operative position and said antifriction means in contact with the rear end of said block thereby assisting said primary recoil absorption means to push and speed the block into said closed position against the breech.

18. In a firearm of the type having a frame and a receiver, a barrel mounted on the frame and having a shell-receiving chamber with a breech that is located adjacent to a rear end of the barrel, the shell-receiving chamber including a mouth on one end thereof into which a shell is inserted for firing, a block having sidewalls and a front end and a rear end housed within the receiver for reciprocating movement between a closed position with said front end covering the breech and a retracted position uncovering the breech, with shell firing imparting recoil energy to the block and producing an empty shell casing, means for ejecting the empty shell casing from the breech and means for positioning a new shell for insertion into the breech with the empty shell casing being ejected from the breech as said block moves from said closed position to said retracted position and the new shell being inserted into the breech as said block moves from said retracted position to said closed position and a primary recoil absorption means including a spring normally biasing the block into said closed position operative during a retraction stroke thereof in which the block moves along a path from the closed position into the retracted position, to absorb at least a portion of a recoil energy imparted to the block by firing of the shell while the empty shell casing is being ejected and during a return stroke of the block in which the block moves from the retracted position to the closed position to force said block into contact against the new shell to pick up that new shell from a source of unfired shells and force same into the shell-receiving chamber, the improvement in combination therewith comprising:

secondary recoil absorption means which immediately after firing is in movement-controlling connection with said block during a time the empty shell is being ejected to slow down the retraction stroke of the block as it moves away from the closed position covering the breech and then after the empty shell has been ejected said secondary recoil means becomes essentially inactive with respect to controlling movement of said block and then said secondary recoil means re-engaging said breech block prior to the new shell being contacted by the breech block for insertion into the breech, to once again cooperate with said primary recoil absorption means to speed up the return stroke of said block, said secondary recoil absorption means including a lever arm having an antifriction means mounted thereon, said lever arm being connected to the frame for pivotal movement between an operative position with said antifriction means in engagement with the rear end of the block and an inoperative position with said antifriction means located alongside a sidewall of said block, a secondary recoil absorption means spring means which is connected to said lever arm and which cooperates with the primary recoil absorption means when said antifriction means is in said operative position in engagement with the rear end of said block to assist the primary recoil absorbtion means in slowing down said retraction stroke of said block as it moves away from the breech, said lever arm being sized and connected to said frame so that as said block moves in the retraction stroke, said antifriction means is moved out of contact with the rear end of said block and into said inoperative position alongside the sidewall thereof just prior to said block reaching an end of said retraction stroke to decouple said secondary absorption means from said block such that any recoil energy remaining in the block when the antifriction means moves into said inoperative position is absorbed solely by the primary recoil absorbtion means, said primary recoil absorption means being solely operative after said secondary recoil absorption means has been decoupled from said block to terminate the retraction stroke of said block and start it on said return stroke, said lever arm being sized and connected to said frame so that after said block has progressed part way along said return stoke under bias imparted thereto by the primary spring recoil absorption means, said lever arm is moved by bias imparted thereto by said secondary recoil absorbtion means spring means to move said antifriction means back into its operative position to operatively re-coupled said secondary recoil absorption means to said block prior to the block picking up an unfired shell to thereby assist said primary recoil absorption means to push and speed up the block into said closed position against the breech.

19. The improvement as set forth in claim 18 in which said secondary recoil absorption means includes a second stage recoil absorption means.

20. The improvement as set forth in claim 19 in which said second stage recoil absorption means includes a second lever arm having another antifriction means thereon and being connected to the frame, said second lever arm being spaced from said lever arm to be contacted by the breech block during its retraction stroke after said block has passed the lever arm.

21. The improvement as set forth in claim 20 wherein said second stage recoil absorption means includes a second spring.

22. The improvement as set forth in claim 21 wherein the receiver includes a front, a rear, a top and a bottom and said first and second lever arms of said secondary recoil absorption means are connected to the frame to extend from the receiver bottom toward the receiver top when in the operative position and to extend toward the receiver rear when in the inoperative position.

23. The improvement as set forth in claim 19 in which said second stage recoil absorption means includes a second lever arm having another antifriction means thereon and being connected to the frame, said second lever arm being mounted to have said another antifriction means engage the rear end of the block simultaneously with the antifriction means mounted on the second lever arm, and to move out of engagement with the rear end of the breech block simultaneously with the antifriction means of the second lever arm.

24. The improvement as set forth in claim 23 wherein the receiver includes a front, a rear, a top, a bottom and sides and said secondary stage recoil absorption means includes a plurality of anti-friction means, with each anti-friction means being located adjacent to one of the receiver sides.

25. The improvement as set forth in claim 24 wherein the second stage recoil absorption means includes a second spring.

26. In a bolt-action weapon of a type used to fire cartridges which generate a pressure sufficient to damage to cartridge casing when fired and which are thus liable to jam the weapon, the weapon including a frame and a receiver housing a bolt for reciprocating movement along a path between a closed position seated against a breech which is located at a mouth of a cartridge-receiving chamber which is located at a rear end of a tubular barrel which opens into a front end of a chamber and a retracted position uncovering the breech, with cartridge firing imparting recoil energy into the breech and producing an empty cartridge casing, means for ejecting the empty cartridge casing from the breech and means for positioning a new cartridge for insertion into the breech, a primary recoil absorption means which includes a yieldable spring member located behind the bolt and which continuously urges the bolt into the closed position and operates to absorb the recoil energy which is associated with firing of a cartridge with cartridges being fed from a clip into position to be moved by the bolt as that bolt moves into the closed position from the retracted position, the improvement in combination therewith comprising:

secondary recoil absorption means for cooperating with the primary recoil absorption means for controlling opening of the breech after a cartridge is fired and for controlling recoil movement of the bolt along a predetermined portion of bolt recoil movement, said secondary recoil absorption means including a support element mounted on the weapon frame adjacent to the bolt to be movable in a direction of bolt movement, a secondary recoil spring connected to said support element and biasing said support element in a direction opposite to bolt recoil movement, a lever means mounted on said support element to be located adjacent to said bolt and mounted to pivot in direction of bolt recoil movement, a bolt engaging antifriction means mounted on said lever means to movably engage the bolt on one end of the bolt so that said secondary recoil spring can cooperate with the primary recoil absorption means to control bolt movement, said secondary recoil spring having a spring force that is selected to cooperate with the primary recoil absorption means yieldable spring member to hold the bolt in a closed position against the breech opening immediately after a cartridge is fired to bias the bolt towards the closed position and to cooperate with the primary recoil absorption means to control recoil movement of the bolt away from the breech, said bolt engaging anti-friction means being located to engage the bolt so that as the bolt recoils said bolt-engaging antifriction means moves along said one end of the bolt and is moved in conjunction with said lever means pivotal movement into an inoperative location in which said secondary recoil spring does not interact with said bolt in a manner which cooperates with said primary recoil absorption means yieldable spring member is controlling the recoil of the bolt, said bolt-engaging means being located to engage said one end of the bolt at a position such that said bolt-engaging means is moved into said inoperative position after pressure generated at firing of the cartridge has dissipated to a lever where the breech can be opened without the cartridge casing being damaged by the pressure in the breech adjacent to the cartridge and prior to the bolt reaching the end of its recoil movement whereby said bolt is controlled by the primary recoil absorption means yieldable spring member and said secondary spring for said predetermined portion of its recoil movement and then essentially solely by said primary recoil absorption means yieldable spring member for any remainder of its recoil movement, said bolt-engaging anti-friction means being located to re-engage said one end of the bolt just prior to the bolt reaching a position in its recoil movement in which the bolt picks up the new cartridge from the clip to cooperate with the primary recoil absorption means yieldable spring member in moving the cartridge into the firing chamber.

* * * * *